United States Patent [19]

Bogese, II

[11] Patent Number: 4,501,464

[45] Date of Patent: Feb. 26, 1985

[54] MODULAR CONNECTOR WITH IMPROVED HOUSING AND CONTACT STRUCTURE

[75] Inventor: Stephen B. Bogese, II, Salem, Va.

[73] Assignee: Virginia Patent Development Corporation, Roanoke, Va.

[21] Appl. No.: 326,133

[22] Filed: Nov. 30, 1981

Related U.S. Application Data

[63] Continuation-in-part of Ser. No. 215,054, Dec. 10, 1980, Pat. No. 4,457,570, which is a continuation-in-part of Ser. No. 120,846, Feb. 12, 1980, , which is a continuation of Ser. No. 915,457, Jun. 14, 1978, abandoned.

[51] Int. Cl.[3] ..... H01R 13/50

[52] U.S. Cl. ..... 339;176 M; 339/17 C

[58] Field of Search ..... 339/17 C, 17 LC, 176 M, 339/176 MP

[56] References Cited

U.S. PATENT DOCUMENTS

| | | | |
|---|---|---|---|
| 1,984,036 | 12/1934 | Schwartzmann | 339/218 M |
| 2,294,482 | 9/1942 | Siegmund | 339/278 C |
| 2,911,612 | 11/1959 | Jackson et al. | 339/176 MP |
| 3,106,435 | 10/1963 | Yopp | 339/176 |
| 3,193,791 | 7/1965 | Bock et al. | 339/176 |
| 3,221,288 | 11/1965 | Eads | 339/217 R |
| 3,315,218 | 4/1967 | Aker | 339/218 R |
| 3,369,214 | 2/1968 | Krumreich et al. | 339/105 |
| 3,384,864 | 5/1968 | Schwartz | 339/176 |
| 3,399,377 | 8/1968 | Warzecka | 339/176 |
| 3,487,350 | 12/1969 | Hammell | 339/217 R |
| 3,573,717 | 4/1971 | Lightner | 339/218 M |
| 3,587,029 | 6/1971 | Knowles | 339/176 |
| 3,617,990 | 11/1971 | Colardeau | 339/278 C |
| 3,638,033 | 1/1972 | Johnson et al. | 339/176 MP |
| 3,646,504 | 2/1972 | Classon | 339/17 L |
| 3,696,319 | 10/1972 | Olsson | 339/176 MF |
| 3,850,497 | 11/1974 | Krumreich et al. | 339/126 R |
| 3,954,320 | 5/1976 | Hardesty | 339/99 R |
| 3,990,764 | 11/1976 | Krumreich | 339/176 M |
| 3,990,767 | 11/1976 | Narozny | 339/97 P |
| 3,998,514 | 12/1976 | Hardesty | 339/99 R |
| 4,025,147 | 5/1977 | Van Ardsale et al. | 339/176 MP |
| 4,040,699 | 8/1977 | Rasmussen | 339/176 R |
| 4,084,877 | 4/1978 | Knickerbocker | 339/217 R |
| 4,092,058 | 5/1978 | Eigenbrode | 339/218 M |
| 4,178,062 | 12/1979 | Abbo | 339/192 R |
| 4,186,988 | 2/1980 | Kobler | 339/176 MP |
| 4,193,654 | 3/1980 | Hughes et al. | 339/17 LC |
| 4,195,900 | 4/1980 | Hughes | 339/125 R |
| 4,202,593 | 5/1980 | Abernethy et al. | 339/125 R |
| 4,221,458 | 9/1980 | Hughes et al. | 339/126 R |
| 4,225,209 | 9/1980 | Hughes | 339/126 R |
| 4,231,628 | 11/1980 | Hughes et al. | 339/17 LC |
| 4,269,467 | 5/1981 | Hughes | 339/126 R |
| 4,274,691 | 6/1981 | Abernethy et al. | 339/278 C |
| 4,292,736 | 10/1981 | Hughes et al. | 29/884 |
| 4,296,550 | 10/1981 | Kobler | 29/884 |
| 4,296,991 | 10/1981 | Hughes et al. | 339/176 MP |

*Primary Examiner*—Joseph H. McGlynn
*Assistant Examiner*—Gary F. Paumen
*Attorney, Agent, or Firm*—Saidman, Sterne & Kessler

[57] ABSTRACT

An electrical connector adapted to receive a modular plug comprises a housing having a front portion, a rear portion and an outer wall, a plug receiving opening in the front portion and extending toward the rear portion, the plug receiving opening comprising a rear portion, a plurality of conductors associated with the housing, each conductor comprising a first end portion extending from the outer wall, a first intermediate portion substantially perpendicular to the first end portion, a second intermediate portion substantially perpendicular to the first intermediate portion, and a second end portion extending generally from the rear portion of the plug receiving opening toward the front portion of the housing. A method for assembling the connector comprises substantially, in proper sequence, forming specified bends in conductors associated with the connector and inserting the conductors in the housing.

12 Claims, 3 Drawing Figures

MODULAR CONNECTOR WITH IMPROVED HOUSING AND CONTACT STRUCTURE

REFERENCE TO RELATED APPLICATION

This application is a continuation-in-part of application Ser. No. 215,054, filed Dec. 10, 1980, now U.S. Pat. No. 4,457,570, which is a continuation-in-part of application Ser. No. 120,846, filed Feb. 12, 1980, which is, in turn, a continuation of application Ser. No. 915,457, filed June 14, 1978 and now abandoned.

BACKGROUND OF THE INVENTION

1. Field of the Invention

The present invention is related to electrical connectors, and more particularly is directed towards a new and improved modular jack adapted to serve as an interface between a standard modular plug and a printed circuit board.

2. Description of the Related Art

In recent years, a great deal of research and development has gone into providing miniature plugs and connectors for low voltage electronic applications. For example, in the telephone industry, increasing use is being made of modular plugs and connectors on the cords, base, handset and wall terminal block of a telephone system. Typical miniature plugs are described, for example, in U.S. Pat. Nos. 3,954,320 and 3,998,514, both in the name of Hardesty. As described therin, the telephone-type modular plug generally includes a dielectric housing having a free end for insertion into a mating modular jack, a cord input end having a cavity for receiving a multi-conductor cord, and a resilient locking tab integrally connected by a flexible hinge to the free end of the dielectric housing and extending obliquely rearwardly therefrom. The modular plug housing is also characterized by a terminal-receiving side having partitions which define side-by-side slots in communication with the cavity. Substantially flat, electrically conductive contact terminals are positioned within the slots and extend into the cavity, and the terminals include insulation-piercing tangs for making electrical engagement with associated conductors of the cord and upper edge portions for making electrical contact external to the plug.

It is desirable that such plugs and connectors be of rugged construction, compact size and high reliability, without requiring excessive manufacturing cost. Such plugs and connectors must also be able to be reliably, rapidly and automatically connected to cable and equipment components, respectively.

While the plugs and connectors provided in the past have been generally satisfactory, they suffer from one or more material drawbacks. For example, the miniature connector described in U.S. Pat. No. 3,850,497 is generally a rugged and compact unit. However, the complexity of the contact wire assembly utilized in the housing of the connector results in a high manufacturing cost due to the many components which must be assembled in a precision arrangement. Additionally, the interconnect portions of the contact wire assembly which protrude from the rear of the connector housing consist of flexible jumper wires having spade terminals or solder tabs for making connections to equipment components. Such terminals or tabs must be manually anchored or set in position for making the desired electrical connections. This procedure results in high labor costs when such connectors are mounted, for example, on printed circuit boards or to electronic or telephone components. A similar connector is described in U.S. Pat. No. 3,990,764, but suffers from the same deficiencies just described.

The aforementioned connectors also suffer from an additional major drawback. Regulations governing the size and spacing of standardized plugs have been adopted by the Federal Communications Commission. Consequently, any connector designed to mate with such plugs must have corresponding spacing between adjacent contact wires. However, printed circuit boards which are utilized extensively, for example, in digital data transmission equipment, sensing systems and the like, are presently manufactured with a conductor pad spacing that is different from the contact spacing on the above-described miniature telephone plugs and connectors. As a result, it has been necessary in the past to provide these connectors with jumper wires or special cables to connect the standard miniature telephone connector or jack to a printed circuit board.

Several U.S. patents, for example, U.S. Pat. No. 4,210,376, set forth miniature connectors for directly interfacing a modular plug with a printed circuit board. The connector of U.S. Pat. No. 4,210,376 comprises a housing having conductors extending over outside walls thereof. One end of each conductor is bent rearwardly into a plug receiving opening in the housing to form spring contact portions. The respective other ends of the conductors extend from the housing in alternating rows, and are properly spaced so as to be compatible with a printed circuit board. Nevertheless, the connector structure described in this patent necessitates a relatively long strip of stamped conductor to be utilized since the conductors are wrapped around the outside wall of the connector housing from the rear to the front thereof and are bent back into the plug receiving opening to form the spring contact portions.

U.S. Pat. No. 4,296,991 discloses what is known as a top mount connector. The conductors associated with this device are shorter than those of U.S. Pat. No. 4,210,376, but are still relatively long as they must extend over an outer wall of the connector housing to be bent rearwardly into the plug-receiving opening. The devices of both these patents require barbs or other retaining means associated with each conductor for retaining it in the housing.

The length of the conductors required for such connectors involves a considerable component cost, inasmuch as such conductors must generally be plated with a precious metal to meet industry standards of reliability, longevity and electrical contact integrity. The precious metal may comprise, for example, gold, and it therefore may be appreciated that it would be highly desirable to provide an improved connector which could utilize conductors of considerably reduced lengths as compared with previous designs. It would also be desirable to obviate the need for retaining barbs and the like, thus further reducing the cost of manufacture and assembly of the connector.

In my copending application Ser. No. 215,054, filed Dec. 10, 1980, which is specifically incorporated herein by reference, I have disclosed a connector which is a substantial improvement over those of the aforementioned patents. The connector of my copending application includes a plurality of conductors whose spring contact portions extend into the conductor housing from the rear of the plug-receiving opening. The spring contact portions of the conductors extend forwardly into the plug-receiving opening, toward the front wall of the housing. As compared with the printed circuit board connectors of the prior art, which required the conductors to extend to the front portion of the housing and then rearwardly into the plug-receiving opening, the conductor structure disclosed in my copending application permits use of much shorter conductors, thus reducing manufacturing and plating costs.

While the connector disclosed in my copending application represents a substantial improvement over previously known connectors, there are features of the device which may be improved upon further. The connector of my copending application cited above includes a portion which is heat-sealed in order to secure the conductors within the housing thereof. It would be desirable to eliminate the need for securing the conductors in this manner. Also, there are certain circuit board mounting applications for which the specific embodiments disclosed in my copending application are not particularly well-suited insofar as physical accessibility of the plug-receiving opening is concerned.

OBJECTS OF THE INVENTION

It is therefore a primary object of the present invention to provide a new and improved electrical connector which overcomes the disadvantages noted above with respect to presently available connectors. It is an object of the invention to provide an improved connector which overcomes the above-noted disadvantages, yet may be manufactured easily and inexpensively.

It is an object of the present invention to provide an electrical connector which utilizes conductors of reduced cost as compared to presently available connectors.

It is another object of the present invention to provide an electrical connector which utilizes conductors of reduced length and uniform cross-section, whereby such conductors may be inexpensively manufactured.

It is a further object of this invention to provide an electrical connector comprising a series of conductors and a housing structure which securely positions the conductors without specific retaining means.

It is still another object of this invention to provide a method for assembling an electrical connector which may be practiced using relatively noncomplex equipment.

A further object of this invention is to provide a method for assembling an electrical connector which does not require heat sealing, fusion, nor a securing step of any type for the conductors associated with the connector.

SUMMARY OF THE INVENTION

The present invention comprises an electrical connector including a housing having a front portion and an outer wall, a plug-receiving opening in the front portion, the plug-receiving opening comprising a rear portion, at least one conductor having one end thereof extending into the plug-receiving opening from the rear portion thereof toward the front portion of the housing, the at least one conductor having another end extending from the outer wall of the housing, at least two bends in the conductor intermediate the ends, and parts of the housing lying on opposite sides of the conductor intermediate the ends, whereby the conductor is retained in the housing. The respective one ends of the conductors may be spaced at a first distance from each other in the plug-receiving opening, while the respective other ends of the conductors extend from the outer wall of the housing at locations spaced a second distance from each other on the outer wall, the second distance being greater than the first distance.

The noted parts of the housing may lie on opposite sides of each of the conductors intermediate the bends, at least one of which may be a substantially 90 degree bend. Each conductor is of uniform cross-section throughout its length.

In a preferred embodiment, the one end of each conductor which extends into the plug receiving opening is curved. The device may further comprise at least one guide slot adjacent the plug-receiving opening, the one end of each conductor extending into a respective one of the guide slots.

In accordance with another of its aspects, the present invention comprises an electrical connector including a housing having a front portion and an outer wall, a plug-receiving opening in the front portion, a partition defining a rear wall of the plug-receiving opening, the partition comprising at least one groove in a surface thereof, at least one conductor having one end thereof extending into the plug-receiving opening from the rear wall thereof toward the front portion of the housing, each conductor comprising an intermediate portion lying in a respective one of the grooves, and a part of the housing lying adjacent each conductor on a side thereof opposite the partition, whereby the conductor is maintained in the groove and in fixed relationship to the housing.

A particular embodiment of the present invention includes an electrical connector comprising a housing having a front portion, a posterior portion and an outer wall, a plug receiving opening in the front portion extending toward the posterior portion, the plug receiving opening having a rear portion and a rear wall thereat, a plurality of conductors associated with the housing, each of the conductors comprising essentially a first end portion extending from the outer wall, a first intermediate portion substantially perpendicular to the first end portion, a second intermediate portion substantially perpendicular to the first intermediate portion, and a second end portion extending generally from the rear portion of the plug receiving opening toward the front portion of the housing.

Partition means are provided at the rear portion of the plug receiving opening and aperture means are located between the partition means and an exterior portion of the housing, the first intermediate portion of each of said conductors being located in the aperture means. The aforementioned exterior portion of the housing may be the outer wall from which the first end portions of the conductors extend. In a preferred embodiment, the first end portions of the conductors extend perpendicularly from the outer wall.

The partition means comprises a plurality of grooves, each of the respective second intermediate portions of the conductors being positioned in a respective one of the grooves. The partition means comprises the rear wall of the plug receiving opening, and the second end portions of the respective conductors extend from the rear wall into the plug receiving opening.

The second end portion of each conductor comprises a spring contact portion. In a preferred embodiment, the spring contact portion may be curved.

The aforementioned first intermediate portions of the respective conductors are arranged in the aperture means in a flared manner, whereby the second intermediate portions of the conductors are closer to one another than are the first end portions. A plurality of slots are provided in the outer wall continguous with the aperture means, the first end portion of each of said conductors extending from the outer wall through a respective one of the slots. A first set of alternate ones of the slots may be relatively shallow, while a second set of alternate ones of the slots may be relatively deep, whereby the first end portions of the conductors are arranged in two rows extending from the outer wall. Such an arrangement renders the connector of the present invention compatible with typical printed circuit board patterns. Means are provided on the outer wall of the housing for mounting the housing on a printed circuit board.

The present invention further comprises a plurality of guide slots provided in the housing adjacent the plug receiving opening. The second end portion of each conductor extends into a respective one of the guide slots and is freely movable therein.

Means are provided for facilitating access from the exterior of the housing to the interior thereof, whereby forming tools may be inserted into the housing to form at least some of the aforementioned portions of the conductors. The access means may comprise at least one opening from the exterior of the housing to the interior thereof. In a preferred embodiment, the present invention comprises an access opening from the exterior of the housing, a plurality of guide slots contiguous with the access opening and open to the plug receiving opening, the second portion of each conductor extending into a respective one of the guide slots and being freely movable therein.

The present invention also includes a method for assembling an electrical connector. The method comprises essentially the steps of providing a housing for the connector, the housing comprising at least a plug receiving opening and aperture means communicating with the plug receiving opening, providing at least one elongated conductor having a substantially uniform cross-section throughout its length, forming a first bend in the conductor, thereby positioning a first end portion thereof at an angle to an intermediate portion of the conductor, inserting a second end and the intermediate portion of the conductor into the aperture means, inserting a forming tool into the housing in a first direction, thereby bending the conductor in such manner that the second end thereof is positioned at an angle to the intermediate portion, thus securing the conductor in the housing and inserting at least one forming tool into the housing in another direction thereby forming the second end portion into a contact portion. The second end and intermediate portion of the conductor are inserted linearly into the aperture means. In a preferred embodiment, the step of inserting at least one forming tool into the housing in the aforementioned another direction comprises inserting opposed forming tools into the housing, thereby forming the second end portion into a curved contact portion. The angles formed in the conductors may be substantially 90 degree angles.

BRIEF DESCRIPTION OF THE DRAWINGS

The foregoing and other objects, aspects and features of the present invention will be more fully appreciated as the same becomes better understood from the following detailed description of the present invention when viewed together with the accompanying drawings, in which.

DESCRIPTION OF A PREFERRED EMBODIMENT

Figure 1:
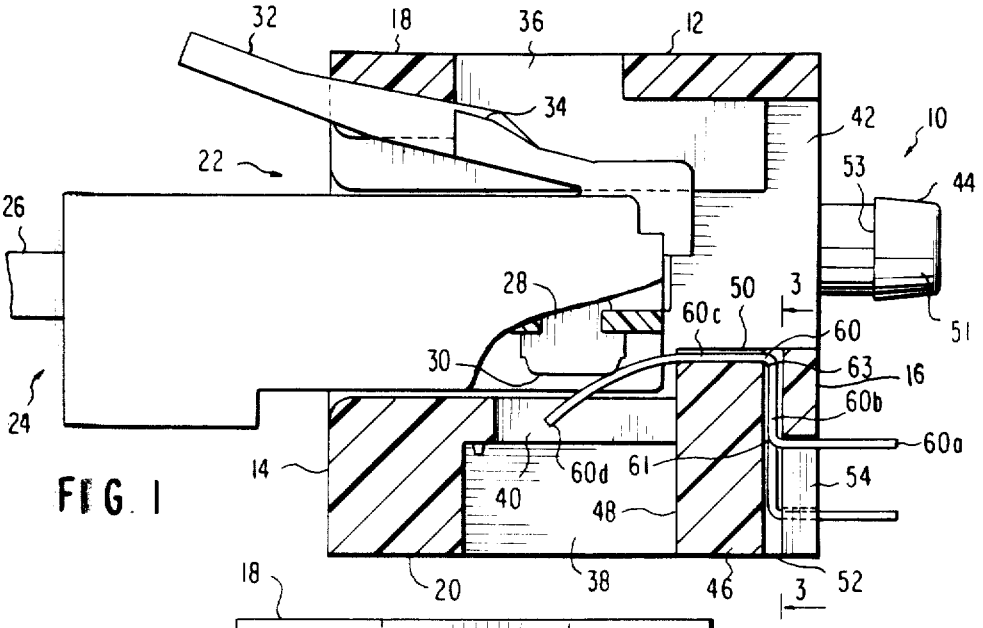
FIG. 1 is a side sectional view of a preferred embodiment of an electrical connector in accordance with the present invention.
Figure 2:
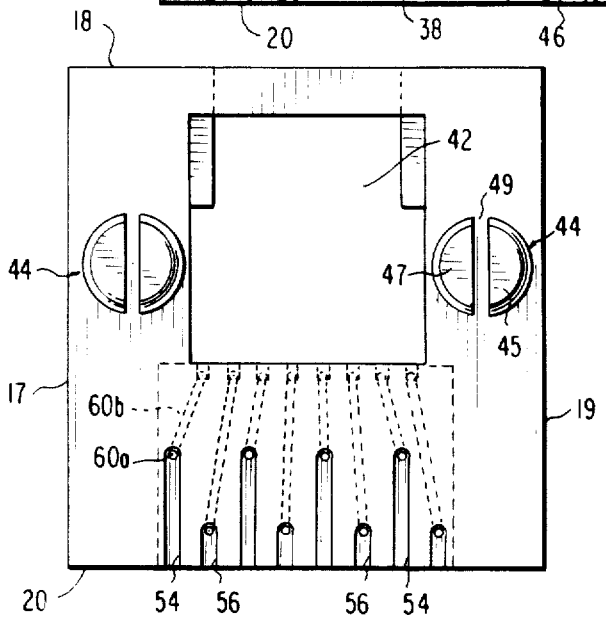
FIG. 2 is a rear elevational view of the embodiment of FIG. 1.

FIG. 1 illustrates what is known as a top mount jack, designated generally by reference numeral 10. While the device is illustrated as a top mount jack, it is to be understood that the principles of the present invention, as set forth in the appended claims, may be applicable to connectors which mount in other fashions. Jack 10 comprises a dielectric housing 12 having a front wall 14, a rear wall 16, a top wall 18, and a bottom wall 20. Jack 10 also includes a pair of side walls 17 and 19, as seen in FIG. 2. It is to be understood that the terms "top", "bottom", "front", "rear", etc. are used only with reference the accompanying drawings for the sake of convenience. Jack 10 may be used in virtually any position, and any surface thereof may comprise the top, bottom, etc.

Formed in front wall 14 is a plug receiving opening 22. Plug receiving opening 22 is sized to receive a modular mating plug 24 as described, for example, in U.S. Pat. No. 3,954,320. Plug 24 terminates a plurality of insulated wires in, for example, a cable 26. A plurality of side-by-side insulation-piercing electrical contacts 28 are associated with plug 24. Contacts 28 are generally planar and have barbs or the like for piercing the insulation of the conductors associated with cable 26. Contacts 28 are often plated with a precious metal to improve their conductivity. In accordance with prevailing standards promulgated by the Federal Communications Commission, contacts 28 are arranged side-by-side 0.040 inch on center. The lower exposed edges 30 of contacts 28 are adapted to contact spring portions of side-by-side conductors in jack 10, to be described in greater detail herein.

Plug 24 also includes, as is conventional, a locking tab 32 having a pair of spaced shoulders 34 adapted to mate with corresponding spaced shoulders in housing 12.

Top wall 18 includes an opening 36 extending downwardly into plug receiving opening 22. Bottom wall 20 includes a recess 38 terminating in a plurality of side-by-side guide slots 40 for purposes to be described in greater detail herein. Rear wall 16 has an opening 42, to the sides of which are positioned a pair of bifurcated mounting posts 44 adapted to be fit in properly sized holes in a printed circuit board (not shown) for mounting jack 10 to the board. As described in my parent application Ser. No. 215,054, mounting posts 44 each include a pair of symmetrically formed post members 45 and 47 having a slot 49 positioned longitudinally therebetween. Slot 49 permits post members 45 and 47 to flex towards one another as they are inserted through the printed circuit board hole (not shown). Post members 45 and 47 each include a tapered side wall 51 terminating in a lateral flange 53 that serves to snap-fit and thereby retain the posts 44 in the hole after insertion.

Extending transversely between side walls 17 and 19 is an intermediate barrier or partition 46. Partition 46 has a front wall 48 which forms a rear inner wall or boundary at the rear of plug receiving opening 22, as well as one wall of guide slots 40. Partition 46 also includes a top wall 50.

Between rear wall 16 and partition 46 is positioned a transverse aperture 52 of sufficient width to accommodate conductors, as will be described hereinafter. As best seen in FIG. 2, a plurality of conductor receiving slots 54 and 56 are formed in rear wall 16 extending upwardly from bottom wall 20 contiguous with aperture 52. A plurality of parallel grooves 58 are formed in top wall 50 of partition 46.

A plurality of conductors 60 are associated with housing 12 of the present invention. Each conductor 60 comprises a first end portion 60*a*, generally parallel with the longitudinal axis of opening 22 a first intermediate portion 60*b* generally perpendicular to portion 60*a*, a second intermediate portion 60*c* generally perpendicular to portion 60*b*, and a second end portion 60*d* extending forwardly into plug receiving opening 22 from the rear portion thereof. Portion 60*d* comprises a spring contact portion for engaging contacts 28 of plug 24 while portion 60*a* comprises a solder post for insertion through holes in a printed circuit board (not shown) and subsequent soldering.

Each second end portion 60*d* of conductors 60 extends into a corresponding guide slot 40 adjacent plug receiving opening 22. Portions 60*d* move freely within guide slots 40 in response to pressure from contacts 28. The purpose of guide slot 40 is two-fold. Firstly, guide slots 40 prevent portions 60*d* from contacting one another in the event lateral pressure is applied to these portions as a result of abuse or misalignment of contacts 28. This will prevent shorting of circuits associated with the respective conductors. Additionally, guide slots 40 serve to shroud the tips of portions 60*d*. Should a small child insert a finger into plug receiving opening 22, the finger will not become impaled on the conductor tips.

The structure of a connector in accordance with the present invention is particularly advantageous as it may be quickly and inexpensively assembled. The present invention provides a connector, and a method for assembling the connector, which firmly and positively anchors the conductors associated therewith, while obviating the need for auxiliary anchoring means or for an anchoring step in the assembly method.

In assembling the present invention, conductors 60 are initially formed from appropriate lengths of conductive material having a substantially uniform cross-section throughout their length. Conductors 60 may be of any cross-sectional shape, such as round conductor wires or rectangular, stamped conductor strips, and are generally coated with a precious metal, such as gold, to increase their conductivity, longevity and reliability. Conductors 60 may be coated or plated with other metals, such as tin, or a portion thereof may be coated with tin while another portion thereof may be coated with gold, as will be explained in greater detail below.

A first bend 61 is then formed in each conductor, orienting first end portion 60*a* substantially perpendicular to first intermediate portion 60*b*. Remaining portions 60*b*, 60*c* and 60*d*, which are as yet lying along a straight line, are inserted linearly into aperture 52 until portions 60*a* of the respective conductors become seated within slots 54, 56, respectively. First intermediate portions 60*b* are positioned so that the conductors are in alignment with respective grooves 58 in top surface 50 of partition 46. As a result, first intermediate portions 60*b* are arranged within aperture 52 in a flared manner, non-parallel to each other.

A forming tool is then inserted into housing 12 through opening 42, thus making a second bend 63 in the respective conductors and positioning second intermediate portions 60*c* substantially perpendicular to first intermediate portions 60*b*. As a result of the flared arrangement of portions 60*b*, second intermediate portions 60*c* are closer to one another than are first end portions 60*a*. Portions 60*c* may thus be spaced at 0.040 inch on center as is standard for modular connectors, while portions 60*a* may be placed 0.050 inch on center as is standard for many printed circuit boards, especially those whose design is computer-aided. As stated another way in my parent application Ser. No. 215,054, this differential spacing causes the end portions 60*a* of the conductors to extend from external wall 16 in two substantially parallel rows, the end portions of any two conductors in one row being laterally spaced from each other a distance greater than the corresponding spring contact portions 60*d* of the same two conductors.

Following formation of second bend 63, portions 60*c* and 60*d* remaining lying along a straight line. A forming tool is now inserted into plug receiving opening 22 and a second forming tool is inserted through opening 38 and guide slots 40. The forming tools are of such configuration that second end portion 60*d* is deformed and assumes a curved configuration as illustrated, the tip thereof entering guide slot 40. It may be appreciated that the tip of spring contact portion 60*d* forms a free end portion that is closer to front wall 14 thatn the rest of spring contact portion 60*d*.

Figure 3:
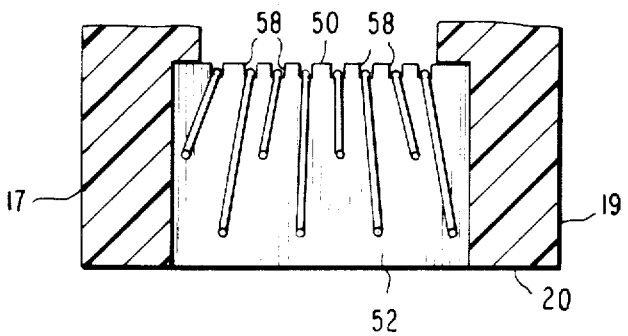
FIG. 3 is a partial sectional view along line 3—3 of FIG. 1.

When plug 24 is inserted into plug receiving opening 22, contacts 28 exert pressure on spring contact portion 60*d*. Because first intermediate portion 60*b* is confined between partition 46 and rear wall 16, conductor 60 is positively and effectively restrained from movement in a horizontal direction, as viewed in FIG. 1. The abutting relationship between second intermediate portion 60*c* and upper surface 50 of partition 46 prevents downward movement of conductors 60, while abuttment of first end portion 60*a* with slots 54 and 56 prevents conductors 60 from moving upwardly as viewed in FIG. 1. Furthermore, since conductors 60 are seated within slots 54 or 56 and in grooves 58, conductors 60 may not move in a transverse direction, to the right or left, as seen in FIGS. 2 and 3. Aperture 52 is of sufficient width to accommodate conductors 60, but sufficiently narrow not to allow significant movement therein. As a result, conductors 60 are not free to rotate in any direction.

It is evident that a housing and conductor configuration in accordance with the present invention postively and effectively fixes the positions of the respective conductors within the housing without requiring auxiliary anchoring means of any type. Additionally, the method for assembling a device in accordance with the present invention does not require a heat-sealing step nor anchoring procedures of any type. The conductors may therefore be formed from inexpensive wire stock or stamped materials, and the device may be assembled using relatively noncomplex assembly equipment. Assuming that housing 12 has been molded or otherwise formed to proper tolerances, conductors 60 will automatically be properly positioned within slots 54, 56, aperture 52 and grooves 58 using relatively simple assembly techniques and equipment. Thus, the need for highly precise assembly devices is obviated.

The mating pressure of spring contact portions 60*d* with contacts 28 may be controlled by varying the angle at which portions 60*d* are bent downwardly, as well as by properly selecting conductor stock of a desired spring constant. When mating pressure between contacts 28 and portions 60*d* is relatively low, it is generally necessary to plate portions 60*d* with a precious metal, such as gold. If the mating pressure is increased, it may be sufficient to plate portion 60*d* with a much less expensive metal, such as tin, which will reduce the cost of the conductors.

In any event, conductors 60 in accordance with the present invention have a substantially reduced component cost as compared with those associated with prior art printed circuit board connectors. In prior art devices, the conductors extend across one or more exterior walls of the housing to a position generally at the front of the plug receiving opening. The conductor is then bent to extend rearwardly into the plug receiving opening. This arrangement necessitates a relatively long conductor of relatively high cost, especially when plated with a precious metal. Conductors 60 of the present invention, extending from rear wall 48 of plug receiving opening 22, are substantially shorter than conductors associated with prior art connectors. Material costs are thus reduced, especially when plating with costly metals is required.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

I claim as my invention:

1. A modular jack for directly coupling to a printed circuit board a modular plug of the type which includes a dielectric housing having a free end for insertion into the modular jack, a cord input end having a cavity for receiving a multi-conductor cord, a resilient locking tab integrally connected by a flexible hinge to the free end of the dielectric housing and extending obliquely rearwardly therefrom, a terminal-receiving side having partitions which define side-by-side slots in communication with the cavity, electrically conductive contact terminals positioned within the slots and extending into the cavity, the contact terminals including insulation-piercing tangs for making electrical engagement with associated conductors of the cord and upper edge portions for making electrical contact external to the plug, the modular jack comprising:

(a) an insulating housing having a front end, a rear end, a plurality of external walls, and means extending integrally from one of said external walls for mounting said insulating housing to the printed circuit board;

(b) plug-receiving opening means for receiving the modular plug extending into said front end of said insulating housing and having a plurality of internal walls;

(c) solder post means extending from said rear end of said insulating housing for insertion through alternating, staggered holes formed in the printed circuit board;

(d) a partition wall extending adjacent the rear portion of said plug-receiving opening means and having conductor-receiving means formed therein;

(e) a plurality of electrical conductors in side-by-side spaced-apart relationship, each of said conductors comprising:

(i) an intermediate portion positioned in said conductor-receiving means in said partition wall;

(ii) a spring contact portion extending from said intermediate portion into said plug-receiving opening means from said rear portion of said plug-receiving opening means towards said front end of said insulating housing; and (iii) an end portion extending perpendicularly beyond said one external wall to form said solder post means;

(f) said spring contact portions of said conductors engaging the upper edge portions of the contact terminals of the modular plug upon insertion of the plug into said plug-receiving opening means; and (g) said plug receiving opening means further having recess means formed therein for receiving and releasably retaining the locking tab of the modular plug.

2. The modular jack as set forth in claim 1, further comprising conductor differential spacing means in said insulating housing for causing said end portions of said conductors to extend from said one external wall in two substantially parallel rows, the end portions of any two conductors in one row being laterally spaced from each other a distance greater than the corresponding spring contact portions of the same two conductors.

3. The modular jack of claim 1, wherein said intermediate portion comprises first and second intermediate portions, said second intermediate portion extending from said spring contact portion into said conductor receiving means, said first intermediate portion formed between said end portion and said second intermediate portion and extending across said rear end of said housing.

4. The modular jack of claim 3, wherein said one external wall of said housing is spaced from said partition wall so as to define aperture means therebetween within which said first intermediate portions of said conductors are positioned.

5. The modular jack of claim 4, wherein said first intermediate portions of said conductors in said aperture means are non-parallel to each other.

6. The modular jack of claim 3, wherein said first intermediate portions are spaced closer together at the junction thereof with said second intermediate portions than at the junction thereof with said end portions.

7. The modular jack of claim 3, wherein said conductor-receiving means comprises a plurality of grooves, each of said second intermediate portions being positioned respectively in one of said grooves.

8. The modular jack of claim 7, wherein said partition wall includes a top wall adjacent to said plug-receiving opening means, said grooves being formed in said top wall.

9. The modular jack of claim 1, wherein said plug-receiving opening means is defined by a longitudinal axis and wherein said end portions of said conductors are parallel to said longitudinal axis.

10. The modular jack of claim 9, wherein said axis lies parallel to the direction of movement of the modular plug into and out of said insulating housing.

11. The modular jack of claim 1, wherein said mounting means includes at least one mounting post comprising a pair of post nembers separated by a slot to permit said post members to flex towards one another as said mounting post is inserted through a mounting hole in the printed circuit board.

12. The modular jack of claim 11, wherein each of said post members include a tapered side wall for facilitating insertion through the mounting hole, said side wall terminating in a lateral flange for snap-fitting and thereby retaining said mounting post in the mounting hole.

* * * * *

UNITED STATES PATENT AND TRADEMARK OFFICE

CERTIFICATE OF CORRECTION

PATENT NO. : 4,501,464

DATED : February 26, 1985

INVENTOR(S) : Stephen B. Bogese, II

It is certified that error appears in the above—identified patent and that said Letters Patent is hereby corrected as shown below:

On the front cover page of the patent after "[45]" and before "Date of Patent", insert -- * --.

On the front cover page, after line 6, insert
-- [*] Notice: The portion of the term of this patent subsequent to July 3, 2001, has been disclaimed. --.

Column 8, line 32, delete "thatn" and insert -- than --.

Column 11, line 3, delete "nembers" and insert -- members --.

Signed and Sealed this

*Twenty-fifth* Day of *June 1985*

[SEAL]

*Attest:*

DONALD J. QUIGG

*Attesting Officer* *Acting Commissioner of Patents and Trademarks*